United States Patent [19]

Patschorke

[11] Patent Number: 4,907,508

[45] Date of Patent: Mar. 13, 1990

[54] PRINTING CYLINDER WITH RUBBER COATING FOR LETTERPRESS, FLEXOGRAPHY, ROTOGRAVURE AND ROTARY OFFSET

[75] Inventor: Joachim Patschorke, Brunnen, Switzerland

[73] Assignee: Celfa AG, Seewen, Switzerland

[21] Appl. No.: 273,383

[22] Filed: Nov. 17, 1988

[30] Foreign Application Priority Data

Nov. 24, 1987 [EP] European Pat. Off. ..... 87117263.1

[51] Int. Cl.[4] ..... B41C 1/02

[52] U.S. Cl. ..... 101/401.1; 101/415.1

[58] Field of Search ..... 101/401.1, 415.1, 389.1, 101/378

[56] References Cited

U.S. PATENT DOCUMENTS

| | | | |
|---|---|---|---|
| 3,584,580 | 6/1971 | Schulz | 101/415.1 |
| 3,649,439 | 3/1972 | Ross | 101/401.1 |
| 3,705,072 | 12/1972 | Rosvold | 101/401.1 |
| 3,730,092 | 5/1973 | Picuard et al. | 101/415.1 |
| 3,818,651 | 6/1974 | Eells | 101/415.1 |
| 3,832,948 | 9/1974 | Barker | 101/401.1 |
| 3,913,480 | 10/1975 | Dauner et al. | 101/415.1 |
| 4,537,129 | 8/1985 | Heinemann | 101/415.1 |
| 4,620,482 | 11/1986 | Fischer | 101/415.1 |
| 4,742,769 | 5/1988 | Zeller | 101/415.1 |
| 4,802,413 | 2/1989 | Schroeder | 101/415.1 |

*Primary Examiner*—Eugene H. Eickholt

*Attorney, Agent, or Firm*—Sprung Horn Kramer & Woods

[57] ABSTRACT

A printing cylinder with a rubber coating for letterpress, flexography, rotogravure, and rotary offset. To reduce channel beat or engagement impact, the outer layer of the rubber coating is shorter at the tensioning-in edges than the inner layer and is at an angle of at most 90° to it at both ends. It has a non-twisting tensioning mechanism with a narrowed introduction slot at the tensioning channel.

7 Claims, 3 Drawing Sheets

Figure 1:
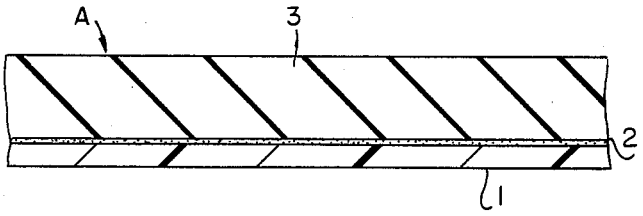

PRINTING CYLINDER WITH RUBBER COATING FOR LETTERPRESS, FLEXOGRAPHY, ROTOGRAVURE AND ROTARY OFFSET

The invention relates to a printing cylinder appropriate for letterpress, flexography, rotogravure, and rotary offset, with a roller, a tensioning mechanism with a narrowed tensioning channel, and a rubber coating, the outer layer of which is cut back at the ends of the channel to the extent that the remaining ends can be inserted into the tensioning mechanism in such a way that no tensioning-channel opening is visible on the surface of the rubber in the tensioned state.

Various types of cylinder employed for different purposes in letterpress, flexography, rotogravure, and rotary offset are coated with rubber to provide resilience and transfer ink. The function of the rubber coating on the rubber-blanket cylinders employed in rotary offset is to transfer ink. A device called a rubber cylinder is employed in indirect rotogravure. The coating on the counterpressure cylinder employed in letterpress and flexography consists of rubber positioned over the material being printed. Finally, flexography also employs rubber-coated block-form cylinders and, flexographic rollers completely covered with rubber to transfer the ink.

In accordance with their various functions, the rubber coatings must be able to resist pressure, include strength-providing supports that adhere adequately to the layer of rubber, be long-lasting and easy to replace, and be dimensionally stable and uniformly thick. The rubber coatings can be secured to the cylinders with layers of adhesive, which, however, leads to unsatisfactory results. A better but still not optimal solution to the problem of securing the rubber coating involves mechanical fastening systems in what is called the cylinder's tensioning channel.

Measures must be adopted to reduce or suppress vibrations of the printing cylinders in the vicinities of the entrance to and exit from the channel because the pressure force between the cylinders briefly lengthens the radius, commencing with the reversible release of tension on the rubber blanket. The resulting brief change in the pressure force produces a channel beat or engagement impact, as the rubber counterblanket or printing cylinder ascends again, that results in vibrations in the printing system. When the rubber blanket has been tensioned, a gap will be left in this situation between the sections of the blanket at the edges of the cylinder pits. These processes have a negative effect on printing.

European Pat. Application 0 194 618 (Application No. 86 103 093.3, filed Mar. 7, 1986) describes the aforesaid bending dynamics of two printing cylinders during overflow of the tensioning channels with special reference to rotary-offset presses. The inventor proposes redesigning the rubber-blanket or printing cylinder by elevating the axial edges of the tensioning channels above the surface of the cylinder as a means of extensively decreasing the channel beat or engagement impact that occurs while the tensioning channels are being rolled over. The elevated edges of the tensioning channel are embodied in tangential lengths of structural section.

The problem of channel beat or engagement impact is addressed in German OS 3 437 309.8 by redesigning the stiffening strips at the front and rear edges of the blanket on a rubber-blanket cylinder.

Finally, German OS 3 540 581 A1 proposes inserting a filler in the cylinder pit.

In spite of the complexity of their designs, the aforesaid approaches solve the problem only to some extent.

The object of the instant invention is accordingly to redesign the conventional tensioning channel, with the rubber coating over it, that is, to the extent that the overall radius, including the thickness of the rubber coating, will remain constant, eliminating channel beat or engagement impact. The tensioning system, however, is simultaneously to be designed to maintain the mechanical stability of the cylinder as much as possible and to prevent screws from twisting, so that the rubber coating will be evenly tensioned over the whole surface.

This object is attained in accordance with the invention in that enough of the ends of the outer layer of the rubber coating is removed and the remaining inner layer is inserted far enough into the tensioning system to ensure that no tensioning-channel opening will be visible on the surface of the rubber. The cylinder will accordingly not lose contact with the rubber coating along its total circumference as the tensioning channel rolls over, and no fluctuations will occur when the cylinders meet after the channel or the insertion slot has rolled over. The correction at the ends of the rubber coating in accordance with the invention, in conjunction with the tensioning mechanism in accordance with the invention, makes it possible to provide a non-twisting tensioning system for mechanically stable printing cylinders.

I. Printing cylinder for letterpress, flexography, rotogravure, and rotary offset The printing cylinder herein provided consists essentially of a roller, a tubular tensioning channel, and a tubular tensioning mechanism, each with insertion slots, covered with a sheet that, once the channel ends of the rubber layer have been shortened, completely covers the roller in the tensioned state. The overall supporting-layer rubber composition that is conventionally employed as a printing coating is accordingly not secured in the tensioning device, but only the main strength-providing support. The mechanical stress in the vicinity of the tensioning channel, especially where rubber impacts against rubber, is to a large extent accommodated by the strength between the supporting layer and the layer of rubber.

Since a rubber coating with high strength between the supporting layer and the rubber layer and with high dimensional stability is employed for the printing cylinder being claimed, the printing-technology properties of the cylinder are improved even more.

Composite sheets comprising a supporting layer, preferably a sheet of polyester such as polyethylene terephthalate, crosslinked on one or both sides with at least one layer of NBR or another elastomer by means of adhesion promoters that are in themselves known can be employed. These composite sheets, which are manufactured subject to conventional vulcanization conditions, are in one piece and have high dimensional stability and strength due to the chemical bond between the different components.

II. Printing cylinder for flexography

The printing cylinder in accordance with the invention, consisting of a roller, a tensioning mechanism with a narrowed tensioning channel, and a sheet applied as described is also appropriate for flexography.

The manufacture of flexography rollers is now very time-consuming and expensive, and demands a large number of operations, whereby the core of the roller is securely fixed to the elastomer coating. This means that, when a new printing form is made ready, the core of the roller must be cleaned and coated with adhesive and the elastomer plate must be rolled up and bandaged. Subsequent to vulcanization, the bandages are unwrapped, the surface of the elastomer is polished and provided with an image by laser gravure (Technik des Flexodrucks, Coating Reference Books, 1986, Coating-Verlag Thomas und Co., 9001 St. Gall, Switzerland).

The new type of printing element makes it possible to replace the elastomer coating very rapidly. It is even conceivable to make so without replacing the printing roller. This will be possible if the image is separately laser-engraved and the elastomer printing-form component is mounted on a printing roller installed in the press on the core. Prerequisite to this approach is identity of the dimensions and mechanical behavior of the cylinder in the laser-engraving device with that in the press.

The surface of the rubber coating can also be provided with a known type of relief as occurs in what are called automated block-making devices as the result of compression and vulcanization. The aforesaid printing cylinder will in this case be a printing-form cylinder.

When the printing cylinder is employed in rotary offset, letterpress, rotogravure, and flexography, the seam at the edges of the elastomer plate can be sealed with an adhesion promoter or appropriate adhesive.

The mechanical stability of a printing cylinder, which is reduced in conventional embodiments by the built-in tensioning mechanisms and by the creation of a recess for the tensioning channel, is retained in the printing cylinder in accordance with the invention because the rotating component of the tensioning device, the tensioning mechanism, completely occupies, in conjunction with the tensioned-in supporting layer, the tensioning channel and accordingly stabilizes the cylinder.

The rotating component, the tensioning mechanism, is shaped, dimensioned, and mounted in the tensioning channel in such a way that it cannot twist. This makes it possible to create mechanically stable, non-twisting tensioning systems.

Figure 5:
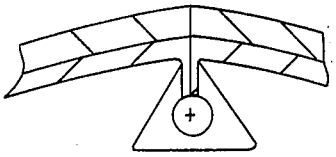
Figure 6:
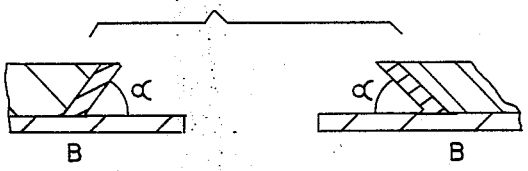

The invention will be further described with reference to the accompanying drawings, wherein:

FIGS. 1 through 4 are sectional views illustrating four embodiments of composite sheets that can be employed in printing cylinders for letterpress, flexography, rotogravure, and rotary offset, FIGS. 5, 6, *7a*, *7b*, and *7c* are sectional views through a system comprising a roller and sheet in accordance with the invention, and FIGS. *8a* to *8d* are sectional views of the whole tensioning system into the printing cylinder.

Figure 2:
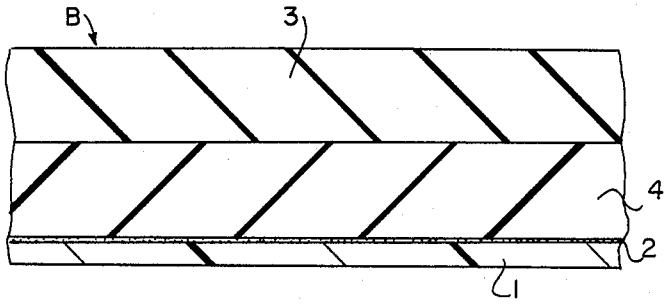
Figure 3:
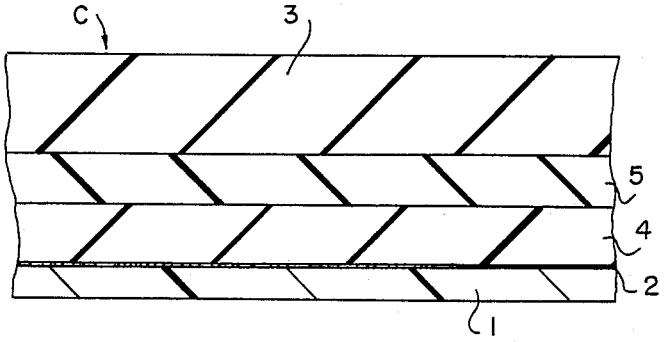
Figure 4:
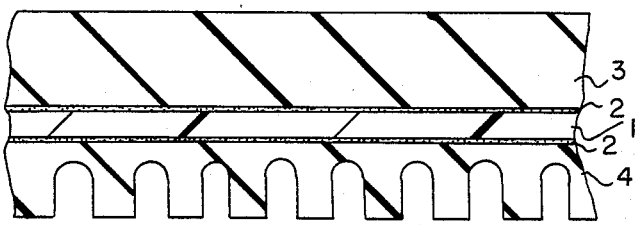

Referring now more particularly to the drawings, the four embodiments of composite sheets that are shown in FIGS. 1 to 4 have an adhesive layer 2. A supporting layer 1, preferably made of polyethylene terephthalate, can be crosslinked for example on one side with a layer 3 of elastomer (FIG. 1) or on one or both sides with one or two layers 3 and 4 of elastomer with different Shore-A hardnesses (FIG. 2).

The sheet can also be made of a supporting layer 1, two layers 3 and 4 of elastomer, and an intermediate driven layer 5 (FIG. 3), or even a waffle-patterned elastomer layer 4.

With regard to the printing cylinder of FIGS. *8a* to *8d*, the cylinder illustrated in FIG. *8a* has a round recess and a slot for the supporting layer.

The tensioning mechanism illustrated in FIG. *8b* is a tube with a slot of the same size as the slot on cylinder and with a radius of the same length as that of the recess in cylinder. The thickness of the tube is reduced to the extent of approximately 500 μm over 90° of its circumference.

The tensioning mechanism illustrated in FIG. *8c* is inserted into cylinder. Once slots and are positioned one on-top of the other, the ends of the processed in accordance with the invention, are introduced and provided with tensioning.

The tensioning mechanism 7 illustrated in FIG. *8d* is rotated to tension rubber coating 12, and tensioning mechanism 13 is secured.

The advantage of these printing cylinders is that no additional devices are necessary to provide the elevations needed to prevent channel beat or engagement impact.

The correction of the ends of the rubber coating in accordance with the invention can be carried out simply (by planing, milling, or grinding) and with the coating on the roller. The narrowing of the tensioning channel makes it possible to create non-twisting tensioning mechanisms and hence mechanically stable printing cylinders.

The printing cylinder can be employed in rotary offset (as a rubber-blanket cylinder) in indirect rotogravure (as a rubber cylinder), in letterpress or flexography (as a counterpressure cylinder), or in flexography (as a printing-form cylinder or flexography roller).

The invention will now be further illustrated with reference to the following examples.

EXAMPLE 1

A rubber coating as illustrated in FIG. 1 is employed to construct a printing cylinder. The system of roller and sheet is as illustrated in FIG. 5.

To prevent channel beat or engagement impact, the tensioning ends of the upper layer (layer 3 of elastomer in the illustrated example) of the rubber coating are removed, by planing, milling, or grinding for example, until the still covered section precisely matches the circumference of the cylinder and the planed, milled, or ground off ends are equal in length. Layer 3 of elastomer is then further shortened on one or both sides until the extension accounts for less than the tensioning force. The sheet is as illustrated in FIG. 6.

The mass of layer 3 of elastomer above base point B dictates the extent to which the overall radius is exceeded, meaning that the excess height depends on angle $\alpha$. If angle $\alpha$ is 90° or more, there will be no excess height, and in the last case, the object of the invention will not be attained.

Figure 7A:
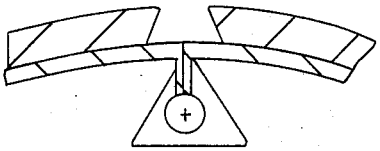
Figure 7B:
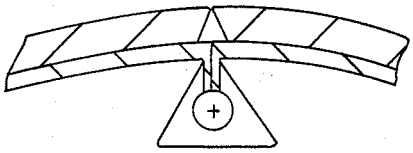
Figure 7C:
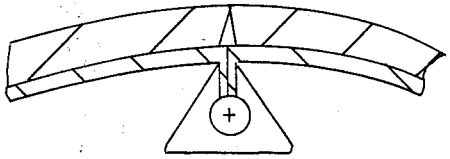
Figure 8A:
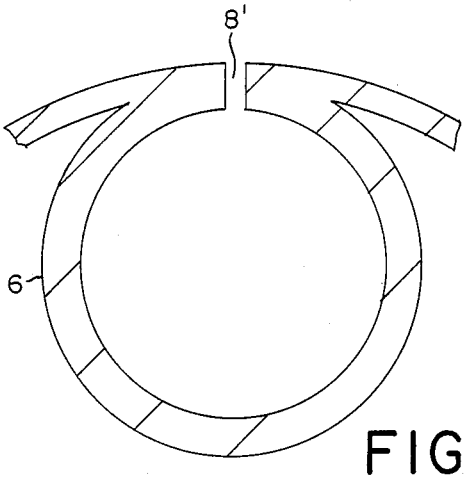
Figure 8B:
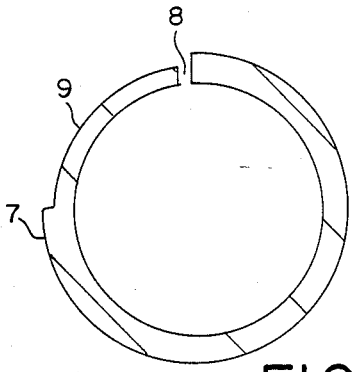
Figure 8C:
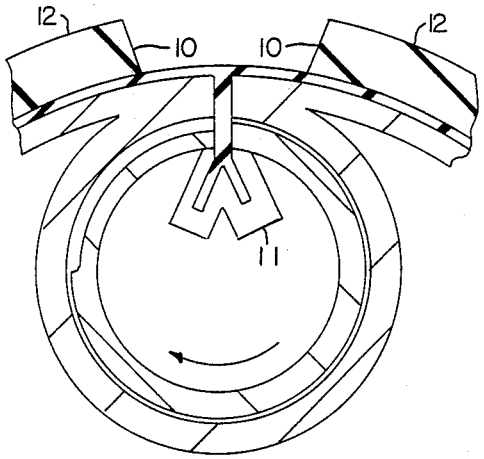
Figure 8D:
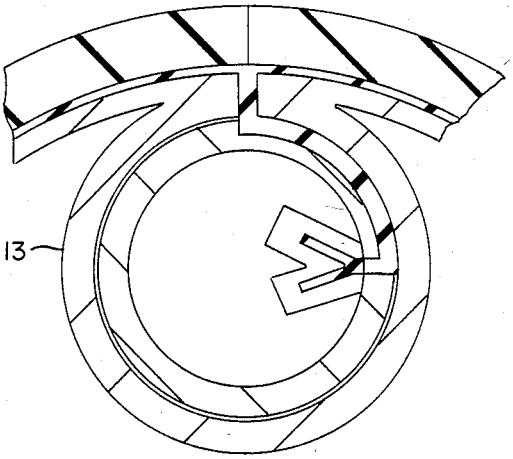

When, now, the sheet, shortened at the ends in accordance with the invention as illustrated in FIG. 7, is inserted and the tensioning mechanisms activated, the edges will be compressed together in such a way as to produce a tangential convexity above the tensioning channel, with the surface of the elastomer closed with the exception of the pressure-application edge. This situation is illustrated in FIGS. *7a* through *7c*. The correction necessitated by the expansion that occurs as the rubber coating is tensioned can be carried out with the coating on, as the tension increases, that is, layer by layer, with a plane, milling machine, or scraper. Once the rubber coating has been tensioned, the convex surface above the tensioning channel can be reduced to the level of the overall radius with a radial plane, a radial milling machine, a radial scraper, or a radial grinder and adjusted to more equal or less than the radius, taking into account the tangential transition into the overall radius into account.

Channel beat or engagement impact is accordingly eliminated.

The minimal channel width requisite to tension the ends of layer 3 remaining subsequent to abrasion depends on how thick the layer is.

When the single-sided covered rubber coating illustrated in FIG. 1 (Example 1) is employed with a supporting layer 1 250 μm thick, with layer 3 of elastomer completely abraded, and with an adhesive layer 2, the minimal channel width will be generally 2 times the thickness of the supporting layer $=2 \times x\ 250\ \mu m = 500\ \mu m$.

EXAMPLE 2

When a rubber coating that is 1.95 mm thick and coated on both sides with elastomer layers of equal thickness is used with a supporting layer 0.250 mm thick, with a layer 3 of elastomer that has been completely abraded, and with a adhesive layer 2, the minimal channel width calculates to generally 2 times the thickness of the coating - 2 times the depth of abrasion $=2\times 1.95\ mm - 2\times 0.85\ mm = 2.2\ mm$.

Printing cylinders with rubber coatings corrected as described in accordance with the invention secured to them can be employed for rotary offset (as rubber-blanket cylinders), for letterpress and flexography (as printing-form and counterpressure cylinders), and even for indirect rotogravure (as rubber cylinders).

It is understood that the specification and examples are illustrative but not limitative of the present invention and that other embodiments within the spirit and scope of the invention will suggest themselves to those skilled in the art.

What is claimed is:

1. In a printing cylinder with a rubber coating for letterpress, flexography, rotogravure, and rotary offset and having a tensioning channel, the improvement wherein the coating has an outer layer and an inner layer, the outer layer of the rubber coating being shorter at the tensioning-in edges than the inner layer and being at an angle of at most 90° to it at both ends, and having a non-twisting tensioning mechanism with a narrowed introduction slot at the tensioning channel.

2. A printing cylinder according to claim 1, wherein the rubber coating includes a supporting layer that is chemically bonded by way of a crosslinking reaction on at least one side by means of an adhesion promoter to at least one layer of NBR or other elastomer.

3. A printing cylinder according to claim 2, wherein the supporting layer is made of polyethylene terephthalate and is 0.250 to 0.35 mm thick.

4. A printing cylinder according to claim 1, wherein the rubber coating is a laser-engraved layer of elastomer.

5. A printing cylinder according to claim 1, wherein the rubber coating is a layer of pressure-molded sheet.

6. A printing cylinder according to claim 1, wherein the rubber coating has a driven layer.

7. A printing cylinder according to claims 1, wherein the tensioning mechanism is a tube that can rotate, that is locked into position, and that has an introduction slot of the same dimensions as a recess on the cylinder and a section that is approximately 500 μm thinner and extends over 90° of its circumference.

* * * * *